United States Patent [19]

Cuellar et al.

[11] Patent Number: 4,668,349

[45] Date of Patent: May 26, 1987

[54] ACID PROMOTED ELECTROCATALYTIC REDUCTION OF CARBON DIOXIDE BY SQUARE PLANAR TRANSITION METAL COMPLEXES

[75] Inventors: Edward A. Cuellar, Shaker Heights; Verna F. Gaylor, Parma, both of Ohio

[73] Assignee: The Standard Oil Company, Cleveland, Ohio

[21] Appl. No.: 921,901

[22] Filed: Oct. 24, 1986

[51] Int. Cl.[4] ..... C25C 1/00

[52] U.S. Cl. ..... 204/59 R; 204/101; 204/290 R

[58] Field of Search ..... 204/59 R, 101, 290 R

[56] References Cited

U.S. PATENT DOCUMENTS 4,523,981 6/1985 Ang et al. ..... 204/72

OTHER PUBLICATIONS

"A Study of . . . Planar Complexes in Solution", Pearce et al, J. Electroanal. Chem., 197 (1986), 317-330.

Barbara Fisher and Richard Eisenberg, "Electrocatalytic Reduction of Carbon Dioxide by Using Macrocycles of Nickel and Cobalt", *J. Am. Chem. Soc.*, vol. 102, pp. 7361-7363 (1980).

M. Ulman, B. Aurian-Blajeni, M. Halmann, "Fuel from $CO_2$: An Electrochemical Study", *Chemtech*, pp. 235-239 (1984).

Charles M. Lieber and Nathan S. Lewis, "Catalytic Reduction of $CO_2$ at Carbon Electrodes Modified with Cobalt Phthalocyanine", *J. Am. Chem. Soc.*, vol. 106, pp. 5033-5034 (1984).

S. Kapusta and N. Kackerman, "Carbon Dioxide at a Metal Phthalocyanine Catalyzed Carbon Electrode", *J. Electrochem. Soc.*, pp. 1512-1514 (1984).

Marc Beley, Jean-Paul Collin, Romain Ruppert and Jean-Pierre Sauvage, "Nickel(II)-Cyclam: An Extremely Selective Electrocatalyst for Reduction of $CO_2$ in Water", *J. Chem. Soc., Chem. Commun.*, pp. 1315-1316 (1984).

*Primary Examiner*—R. L. Andrews

*Attorney, Agent, or Firm*—Joseph G. Curatolo; Larry W. Evans

[57] ABSTRACT

A process for the electrocatalytic reduction of carbon dioxide comprises immersing a transition metal complex with square planar geometry into an aqueous or nonaqueous solution which has been acidified to a hydrogen ion concentration of from about $10^{-5}$ M to about $10^{-1}$ M, adding the carbon dioxide, applying an electrical potential of from about $-0.8$ volts to about $-1.5$ volts vs. SCE, and reducing the carbon dioxide to carbon monoxide.

14 Claims, No Drawings

ACID PROMOTED ELECTROCATALYTIC REDUCTION OF CARBON DIOXIDE BY SQUARE PLANAR TRANSITION METAL COMPLEXES

This application is a continuation of U.S. Pat. application Ser. No. 769,562 filed Aug. 26, 1985, now abandoned.

TECHNICAL FIELD

The present invention is directed toward a method for the electrocatalytic reduction of carbon dioxide to carbon monoxide in an acidified aqueous or nonaqueous solution. The catalyst employed is a transition metal complex with square planar geometry.

BACKGROUND ART

It is well known in the art to employ various square planar transition metal complexes deposited on various electrodes to catalyze the electrocatalytic reduction of carbon dioxide. One example is disclosed in a journal article by Kapusta et al entitled "Carbon Dioxide Reduction at a Metal Phthalocyanine Catalyzed Carbon Electrode" in the *Journal of the Electrochemical Society* (1984) wherein it is disclosed that metal phthalocyanines deposited to a thickness of 10 $\mu g/cm^2$ on a carbon electrode which is them immersed in a neutral solution will catalyze the electrochemical reduction of carbon dioxide to formic acid.

Another journal article is "Catalytic Reduction of $CO_2$ at Carbon Electrodes Modified with Cobalt Phthalocyanine" in the *Journal of the American Chemical Society* (1984) by Lieber et al which disclosed that the electrocatalytic reduction of carbon dioxide was improved by the monolayer coverage of cobalt phthalocyanine on the carbon electrode. The reduction of carbon dioxide to carbon monoxide at a pH of 5 was said to proceed at a turnover rate of 50 $s^{-1}$.

The use of cyclam complexes is disclosed in a journal article by Beley et al entitled "Nickel(II)-Cyclam: An Extremely Selective Electrocatalyst for Reduction of $CO_2$ in Water" in the *Journal of the Chemical Society, Chemical Communications* (1984) wherein it is disclosed that nickel(II) cyclam complexes display a high selectivity for the electrocatalytic reduction of carbon dioxide to carbon monoxide in an aqueous solution having a pH of 4.1. However, the turnover rate is disclosed as only being 32 $hr^{-1}$.

The employment of nickel and cobalt macrocyclic compounds is disclosed in a journal article by Fisher et al entitled "Electrocatalytic Reduction of Carbon Dioxide by Using Macrocycles of Nickel and Cobalt" in the *Journal of the American Chemical Society* (1980) wherein it is disclosed that macrocyclic compounds can be utilized to catalyze the electrocatalytic reduction of carbon dioxide to carbon monoxide in aqueous and mixed aqueous/nonaqueous solvents at a mercury electrode.

Finally, an overview of several different carbon dioxide reduction methods is disclosed in an article "Fuel from $CO_2$: An Electrochemical Study" in *CHEMTECH* (1984) by Ulman et al with relevant discussion being directed toward the use of porphyrins and mercury, zinc, tin, indium, lead and carbon cathodes to improve carbon dioxide reduction.

SUMMARY OF THE INVENTION

In general, the subject invention provides a process for the electrocatalytic reduction of carbon dioxide to carbon monoxide in an acidified aqueous or nonaqueous solution. The process comprises the steps of immersing a transition metal complex with square planar geometry into an aqueous or nonaqueous solution which has been acidified to a hydrogen ion concentration of from about $10^{-5}$M to about $10^{-1}$M; adding the carbon dioxide; applying an electrical potential of from about −0.8 volts to about −1.5 volts vs. SCE; and, reducing the carbon dioxide to carbon monoxide.

PREFERRED EMBODIMENT FOR CARRYING OUT THE INVENTION

The reduction of carbon dioxide to carbon monoxide and organic compounds has been studied for years as a possible method for making synthetic hydrocarbons. However, the basic reactions of $CO_2$ in aqueous and nonaqueous solutions which are as follows:

$$CO_2 \xrightarrow[2e^-]{2H^+} CO + H_2O \text{ (aqueous)}$$

$$CO_2 \xrightarrow[2e^-]{2H^+} HCOOH \text{ (aqueous)}$$

$$2CO_2 \xrightarrow{2e^-} C_2O_4^{2-} \text{ (nonaqueous)}$$

$$2CO_2 \xrightarrow{2e^-} CO + CO_3^{2-} \text{ (nonaqueous)}$$

require large overpotentials which, despite a high conversion efficiency, renders simple electrical reduction of carbon dioxide uneconomical.

An alternative to the unecomonical aspect of high overpotentials is to lower the overpotential by the use of various transition metal complex electrocatalysts. This generally favors carbon monoxide as the resulting product which is a desirable product inasmuch as it can be used as a precursor in a number of other catalytic reactions such as the Fischer-Tropsch reaction for the production of organic complexes. Transition metal complexes with square planar geometry are particularly useful in that the geometry of the complexes allows for the easy formation of transition metal-carbon dioxide complexes or transition metal hydrides. The square planar complex has vacant metal sites for the entering carbon dioxide or proton since there are only four occupied sites in the coordination sphere as compared to six occupied sites of an octahedral complex. The ligands can also be chosen to stabilize the reduced forms of the metal which is required to affect the formation of the carbon dioxide complexes or hydrides. Moreover, the required oxidation state of the metal is often accessible at very low potentials, especially when the ligands have a conjugated structure. Finally, the complex preferably has a reversible reduction potential more negative than −0.5 volts vs. SCE, namely the reduction potential is more negative than, but as near as possible to, the thermodynamic potential for carbon dioxide reduction.

An example of a specific square planar transition metal complex is a metalloporphyrin which has the following structure:

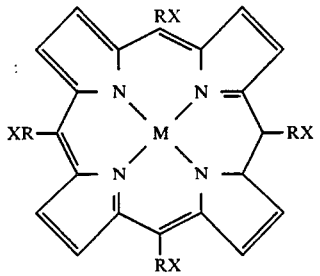

wherein M is a transition metal, R is selected from the group consisting of hydrogen, phenol, alkyl, cycloaliphatic, cycloaromatic, unsaturated t-butyl, and x is selected from the group of H, —COONa, —$SO_3Na$, —COOK, —$SO_3K$, —$COONH_4$, —$SO_3NH_4$ and other positively and negatively charged groups.

Another example of a square planar transition metal complex is a metal phthalocyanine complex which has the following structure:

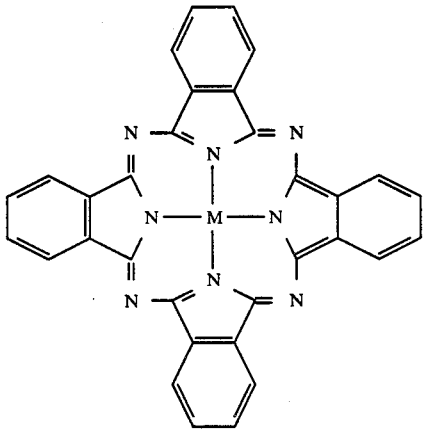

wherein M is a transition metal. A specific example wherein M is cobalt and the compound has been sulfonated is cobalt tetrasulfonated phthalocyanine.

Another example is a metal macrocyclic tetraaza complex which has the following structure:

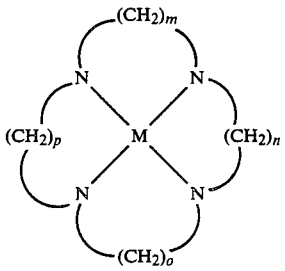

wherein M is a transition metal and m, n, o and p are between 1 and about 20.

Another example is a salen complex which has the following structure:

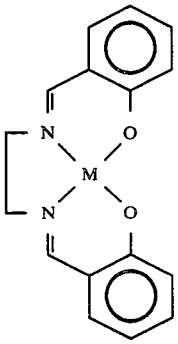

wherein M is a transition metal.

Another example is a cyclam-type ligand system which has the following structure:

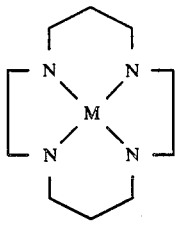

wherein M is a transition metal.

All of these structures are known to catalyze the reduction of carbon dioxide to carbon monoxide. When utilizing these transition metal complexes the key is to get the complexes into solution so that they can be reduced at the cathode. A typical way for doing so is by forming an acid salt derivative of the transition metal complex. The acid salt derivative is typically a combination of a salt chosen from the group consisting of sodium, potassium, lithium, magnesium, calcium and ammonium salts and the sulfonic acid or carboxylic acid derivative of the complex. This acid salt derivative is then dissolved in water. In this manner, the dissolved acid salt can be adsorbed onto or chemically bound onto the cathode prior to reduction. A solution solution is preferred in that the derivative in solution is often strongly adsorbed onto the cathode and a uniform monolayer is presumably formed leading to the more efficient reduction of carbon dioxide.

Suitable reduction electrodes are formed from high overpotential materials such as carbon, lead and mercury. The preferred eldctrode material is carbon which can easily adsorb many transition metal complexes without any prior modification. The cathode can also be a stationary cathode, a rotating ring cathode or a rotating disc cathode so long as the mass transport properties are good.

The cathode is then immersed in the aqueous or nonaqueous solution and acidified to a hydrogen ion concentration of from about $10^{-5}$M to about $10^{-1}$M. Exemplary solutions include aqueous tetraethylammonium sulfate, aqueous $K_2SO_4$, methanolic LiCl and the like with solutions which get protons into solution easiest being preferred. The hydrogen ion concentration can be increased by the addition of such acids as sulfuric acid, other strong mineral acids, citric acids and other weak acids, especially those that can be used to form a buffer in the hydrogen ion concentration range of from about $10^{-4}$M to about $10^{-2}$M.

The carbon dioxide is then added in its gaseous form, an electrical potential is from about −0.8 volts to about −1.5 volts vs. SCE is applied and the carbon dioxide is reduced. The carbon dioxide reduction products are carbon monoxide and trace amounts of alcohols, aldehydes, carboxylic acids and other hydrocarbons with formic acid being the primary constituent of the trace amounts of organic compounds found.

Although the exact pathway and nature of the intermediates of the reduction reactions between carbon dioxide and the transition metal complexes are unknown, the basic reactions utilizing cobalt tetrasulfonated phthalocyanine (CoTSPc) as an example are believed to be as follows:

$$\text{Co(II)TSPc} + e^- \longrightarrow \text{Co(I)TSPc} \quad (1)$$

$$\text{Co(I)TSPc} + e^- \longrightarrow \text{Co(O)TSPc} \quad (2)$$

$$\text{Co(O)TSPc} + 2H^+ + e^- + CO_2 \longrightarrow \text{Co(I)TSPc}^{\oplus} \text{ reduced } CO_2 \quad (3)$$

Note that in step (3) the binding of $H^+$ to Co(O)TSPc, whether by metal-$CO_2$ complexes or metal hydrides, either metal or ligand centered, appears to be rate determining, and thus by increasing the hydrogen ion concentration the reaction rate can be increased. Note that it is known in the art that for carbon dioxide reduction a turnover rate of about 50 $s^{-1}$ can be achieved at −1.15 volts vs. SCE but these rates can be increased by at least a factor of two by increasing the hydrogen ion concentration and working at the lower overpotential of about −1.06 volts. This reduction in overpotential is possible inasmuch as the Co(I) to Co(O) couple is also hydrogen ion concentration dependent and shifts positive by 60 mV per decade of hydrogen ion concentration unit.

The following example demonstrates the practice of the present invention. It is to be understood that this example is utilized merely for illustrative purposes and is not to be considered a limitation of the invention.

EXAMPLE

First the tetrasodium salt of cobalt(II) 4,4',4'',4''' tetrasulfophthalocyanine 2-hydrate was prepared by grinding together 43.2 g of the monosodium salt of 4-sulfophthalic acid, 4.7 g of ammonium chloride, 58 g of urea, 0.68 g of ammonium molybdate and 13.6 g of cobalt(II) sulfate. Nitrobenzene was heated to 180° C. and the solid mixture was added slowly with mixing. The heterogeneous mixture was then heated six hours at 180° C. The remaining solid was washed and then added to 1100 ml of 1N hydrochloric acid saturated with sodium chloride. The resulting solid was then dissolved in 700 ml of 0.1N sodium hydroxide which was then heated to 80° C. and any insoluble impurities removed. Then 270 g of sodium chloride was added and the desired solid precipitated and purified. Note this method was done as detailed in a journal article by Weber et al entitled "Complexes Derived from Strong Field Ligands" in *Inorganic Chemistry* (1965).

A 0.1 mM solution of the cobalt phthalocyanine utilizing nanopure water was then prepared. A glassy carbon electrode of geometric surface area 1.08 $cm^2$, polished with alumina and sonicated, was soaked in the solution for one hour. The electrode was then rinsed with nanopure water and placed in a cathode compartment of a divided, air-tight electrochemical cell. The cell was then charged with an electrolyte solution comprising aqueous 0.1M $K_2SO_4$ and 0.05M in citric acid with the citric acid acting as a buffer. The hydrogen ion concentration was then adjusted through the addition of 0.1M sulfuric acid.

The solution was then purged for about one hour with carbon dioxide. Electrolysis was then performed with the working electrode held at −1.06 volts vs. SCE while the solution was rapidly stirred. Gas samples were withdrawn and analyzed by gas chromatography for $H_2$ and carbon monoxide. Coulometric measurements were made to determine the amount of charge consumed in reduction and the moles of $H_2$ and carbon monoxide formed calculated by assuming a $2e^-$ reduction. The hydrogen ion concentration was checked at the end of a run to make sure it had not changed. The results are summarized in Table I.

TABLE I

| Run No. | −log [hydrogen ion] | Time (min) | μmoles $H_2$ | μmoles CO | Total Charge (Coulombs) |
|---|---|---|---|---|---|
| 1 | 5.00 | 175 | 5.75 | 5.03 | 2.03 |
| | | 370 | 9.50 | 7.25 | 3.05 |
| 2 | 4.00 | 61 | 13.00 | 9.09 | 3.67 |
| | | 240 | 30.50 | 22.50 | 8.70 |
| 3 | 4.02 | 250 | 33.70 | 23.60 | |
| | | 260 | 41.80 | 27.30 | 12.92 |
| 4 | 3.08 | 57 | 14.90 | 10.00 | |
| | | 143 | 30.20 | 18.30 | |
| | | 154 | 30.10 | 19.20 | 9.42 |
| 5 | 2.05 | 33 | 16.50 | 6.67 | |
| | | 75 | 30.10 | 13.30 | |
| | | 163 | 43.50 | 17.40 | |
| | | 174 | 42.90 | 17.30 | 11.66 |

Based upon the results of Table I it can be seen that by acidifying the aqueous or nonaqueous solution the required overpotential can be lowered and the rate of carbon dioxide reduction increased. This increase is particularly evident from a change of hydrogen ion concentration of $10^{-5}$M to $10^{-2}$M.

Thus it should be apparent to those skilled in the art that the subject invention provides a process for the electrocatalytic reduction of carbon dioxide utilizing a transition metal complex with a square planar geometry. By acidifying the aqueous or nonaqueous solution the required overpotential can be reduced and the rate of reaction can be increased, as compared to the typical electrocatalytic reduction of carbon dioxide.

It is to be understood that the process can be practiced by utilizing other complexes than the cobalt tetrasulfonated phthalocyanine complex exemplified herein, the example having been provided merely to demonstrate practice of the subject invention. Those skilled in the art may readily select other transition metal complexes, aqueous and nonaqueous solutions, cathodes and ways of increasing the hydrogen ion concentration, according to the disclosure made hereinabove.

Thus it is belived that any of the variables disclosed herein can readily be determined and controlled without departing from the spirit of the invention herein disclosed and described. Moreover, the scope of the invention shall include all modifications and variations that fall within the scope of the attached claims.

We claim:

1. A process for the electrocatalytic reduction of carbon dioxide in an electrochemical cell having at least one working electrode which comprises:

adding carbon dioxide to said cell containing an aqueous or nonaqueous solution which has been acidified to a hydrogen ion concentration of from about $10^{-5}$M to about $10^{-1}$M;

applying an electrical potential to said working electrode of from about −0.8 volts to about −1.5 volts vs. SCE; and, reducing said carbon dioxide to carbon monoxide;

wherein said working electrode carries a transition metal complex with square planar geometry which is immersed in said solution.

2. The process of claim 1, wherein said transition metal is Co.

3. The process of claim 1, wherein said square planar geometry is provided for by a metallophthalocyanine complex.

4. The process of claim 1, wherein said square planar geometry is provided for by a metalloporphyrin complex.

5. The process of claim 1, wherein said square planar geometry is provided for by a macrocyclic tetraaza complex.

6. The process of claim 1, wherein said square planar geometry is provided for by a salen complex.

7. The process of claim 1, wherein said square planar geometry is provided for by a cyclam-type complex.

8. The process of claim 1, wherein an acid salt derivative of said transition metal complex is formed prior to applying potential.

9. The process of claim 8, wherein said acid salt derivative is a salt selected from the group consisting of sodium, potassium, lithium, magnesium, calcium and ammonium salts and a sulfonic acid derivative of said transition metal complex.

10. The process of claim 1, wherein said solution is selected from the group consisting of aqueous tetraethylammonium sulfate, methanolic LiCl and aqueous $K_2SO_4$.

11. The process of claim 1, wherein said electrolyte solution is acidified to a hydrogen ion concentration of from about $10^{-5}$M to about $10^{-1}$M by the addition of an acid selected from the group consisting of weak organic acids and strong mineral acids.

12. The process of claim 1, wherein said cell contains a cathode which is selected from the group consisting of carbon, lead and mercury.

13. The process of claim 11 wherein said weak organic acid is citric acid.

14. The process of claim 11 wherein said strong mineral acids is sulfuric acid.

* * * * *